US009926661B2

(12) United States Patent
Wadhwa et al.

(10) Patent No.: US 9,926,661 B2
(45) Date of Patent: Mar. 27, 2018

(54) STEAMING DEVICE

(71) Applicant: KONINKLIJKE PHILIPS N.V., Eindhoven (NL)

(72) Inventors: Sahil A. Wadhwa, Eindhoven (NL); Mohankumar Krishnan Valiyambath, Eindhoven (NL); Chee Keong Ong, Eindhoven (NL); Kin Leong Yip, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/902,700

(22) PCT Filed: Jul. 9, 2014

(86) PCT No.: PCT/EP2014/064671

§ 371 (c)(1),
(2) Date: Jan. 4, 2016

(87) PCT Pub. No.: WO2015/004169

PCT Pub. Date: Jan. 15, 2015

(65) Prior Publication Data

US 2016/0168778 A1 Jun. 16, 2016

(30) Foreign Application Priority Data

Jul. 9, 2013 (EP) ..... 13175771

(51) Int. Cl.
*D06F 75/18* (2006.01)
*D06F 75/26* (2006.01)
(Continued)

(52) U.S. Cl.
CPC ..... *D06F 75/18* (2013.01); *D06F 75/26* (2013.01); *D06F 87/00* (2013.01); *F22B 1/28* (2013.01); *F22B 1/285* (2013.01)

(58) Field of Classification Search
CPC ..... D06F 75/18; D06F 75/14; D06F 75/26; D06F 75/40; D06F 87/00; F22B 1/28; F22B 1/285
See application file for complete search history.

(56) References Cited

U.S. PATENT DOCUMENTS 3,986,282 A 10/1976 Nelson
4,727,240 A * 2/1988 Provolo ..... D06F 75/26 200/61.52
(Continued)

FOREIGN PATENT DOCUMENTS

CN 202298263 U 7/2012
CN 2611417 Y 4/2014
(Continued)

OTHER PUBLICATIONS

Vertical Steam Construction and Control—Original ID20121D03714—Rejected. Analysis With Reference to Rewritten ID With Exectuion Details, Apr. 2013.

*Primary Examiner* — Ismael Izaguirre

(57) ABSTRACT

The present application relates to a steaming device. The steaming device comprises a steam generator (8) having a heated surface (6), a pump configured to direct fluid against the heated surface (6) to generate steam, an orientation detector to detect orientation of the heated surface (6), and a control unit. The control unit is configured to operate the pump to adjust the flow rate of the pump in dependence on the orientation of the heated surface determined by the orientation detector.

15 Claims, 2 Drawing Sheets

(51) Int. Cl.
*D06F 87/00* (2006.01)
*F22B 1/28* (2006.01)

(56) References Cited

U.S. PATENT DOCUMENTS

| | | | | | |
|---|---|---|---|---|---|
| 5,315,773 | A * | 5/1994 | Iwami | D06F 75/12 | 219/247 |
| 5,404,662 | A | 4/1995 | Patrick | | |
| 5,751,074 | A * | 5/1998 | Prior | H01H 29/002 | 200/190 |
| 7,340,853 | B2 | 3/2008 | Ching | | |
| 8,402,597 | B2 * | 3/2013 | Rosenzweig | A47L 13/22 | 15/320 |
| 8,800,180 | B2 | 8/2014 | Ong | | |
| 2007/0000159 | A1 | 1/2007 | Kubert | | |
| 2010/0000130 | A1 * | 1/2010 | Ng | D06F 75/12 | 38/77.83 |
| 2010/0037495 | A1 * | 2/2010 | Rosenzweig | A47L 11/34 | 38/77.8 |
| 2011/0271565 | A1 | 11/2011 | Ong | | |

FOREIGN PATENT DOCUMENTS

| | | | |
|---|---|---|---|
| DE | 4125412 | A1 | 2/1993 |
| EP | 2418317 | A1 | 2/2012 |
| JP | 06327900 | A | 11/1994 |
| JP | 20000070599 | A | 3/2000 |
| JP | 2012085746 | A | 5/2012 |

* cited by examiner

STEAMING DEVICE

This application is the U.S. National Phase application under 35 U.S.C. § 371 of International Application No. PCT/EP2014/064671, filed on Jul. 9, 2014, which claims the benefit of International Application No. 13175771.8 filed on Jul. 9, 2013. These applications are hereby incorporated by reference herein.

FIELD OF THE INVENTION

The present application relates to a steaming device. In particular, the present application relates to a steam iron or a steamer, and a method of operating a steaming device.

BACKGROUND OF THE INVENTION

Steaming devices, such as steam irons or hand-held steamers are used to remove creases from fabric, such as clothes and bedding. Such a steam iron or hand-held steamer generally comprises a main body with a handle which is held by a user, and has a sole plate with a planar ironing surface which is pressed or located against the fabric of a garment. A steam generator is disposed in the main body, so that water fed from a water receiving chamber to the steam generator is converted into steam. The steam is then discharged from the steam generator through vent holes in the ironing surface towards the fabric of a garment. The steam is used to heat up and momentarily moisten the fabric of the garment in an attempt to obtain effective removal of creases from the fabric.

In a steaming device as described above, water held in the water receiving chamber may be dosed onto a heated surface of the steam generator by means of a pump so as to instantaneously produce steam. To improve ironing performance, high steam rates are desired so as to produce generous amount of steam. It is known to achieve high steam rates by employing high pump flow rates. It is also known to improve the amount of steam generated by a steaming device by maximising the contact between dosed water and the heated surface when the steaming device is in its normal ironing position. The steaming device is in its normal ironing position when the sole plate lies in a horizontal plane and locates against the fabric.

When such a steaming device is in its ironing position, water is dosed vertically onto the heated surface in the direction of gravity. However, dosing of water onto the heated surface is dependent on the orientation of the steaming device. For example, when the steaming device is in an inclined or vertical position during use, in which the sole plate lies at an angle to the horizontal plane, gravity affects the path or trajectory of water pumped towards the heated surface, such that water does not impact the same region of the heated surface as when the steaming device is in its ironing position, or in some cases does not impact the heated surface at all. Additionally, after impact, due to gravity, water does not spread across the heated surface in the same way as when the steaming device is in its ironing position and so it does not get sufficient time in contact with the heated surface designed for the spreading of such large amounts of water in the normal ironing position. This may result in insufficient time for water to spread across the heated surface, or inadequate spreading of water across the heated surface, prior to the next dose of water leading to increased levels of water not being evaporated. As a result water may accumulate at the bottom of the steam generator resulting in excessive water spitting out from the device when the device is orientated back to its ironing position or is kept in an inclined position for too long.

SUMMARY OF THE INVENTION

It is an object of the invention to provide a steaming device which substantially alleviates or overcomes the problems mentioned above, among others. The invention is defined by the independent claims; the dependent claims define advantageous embodiments.

According to the present invention, there is provided a steaming device comprising a steam generator having a heated surface, a pump configured to direct fluid against the heated surface to generate steam, an orientation detector to detect orientation of the heated surface, and a control unit, wherein the control unit is configured to operate the pump to adjust the flow rate of the pump in dependence on the orientation of the heated surface determined by the orientation detector.

With this arrangement, the steaming device can produce sufficient steam irrespective of its orientation without water spill-out, irregular or inadequate steam generation.

In one embodiment, the control unit is configured to operate the pump at a first flow rate and upon the orientation detector detecting a change in orientation of the heated surface the control unit is configured to operate the pump at a second flow rate.

In one embodiment, the control unit is configured to operate the pump at a lower flow rate when the heated surface is in a second orientation than when the heated surface is in a first orientation.

The first orientation may be when the heated surface lies in a horizontal plane, and the second orientation is when the heated surface lies in a plane that is at an inclined angle relative to the horizontal plane.

Thus, the flow rate is configured to decrease as the heated surface moves from a horizontal to an inclined position. This allows for sufficient time for water to spread across the heated surface to evaporate and for the heated surface to heat up again ready for next dose of water In one embodiment, the second orientation is when the heated surface lies in a plane that is at an angle ranging from 5° to 90° relative to the horizontal plane.

The steaming device may further comprise a fluid inlet through which fluid enters and then exits in a direction so as to impact the heated surface within a predetermined region, and the velocity of the fluid exiting the fluid inlet is of a specific value so that as the orientation of the heated surface changes the fluid continues to impact the heated surface within said predetermined region.

This enables the tolerance H to be minimised. H is the tolerance of the fluid impact on the heated surface as the steaming device is moved from an ironing position to an inclined or vertical position. In particular, a high velocity of water enables the amount of contact of dosed water with the heated surface to be maximised even when the direction of water is affected by gravity such that unevaporated water does not collect in parts of the steaming device causing excessive cooling of said parts and leaving areas of the heated surface and/or other parts to overheat.

In another embodiment, the steaming device further comprises a fluid inlet through which fluid enters and then exits in a direction so as to impact the heated surface, and the velocity of the fluid exiting the fluid inlet is unchanged irrespective of the orientation of the heated surface.

The control unit may be configured to operate the pump to control the flow rate of fluid as a function of the angle of orientation of the heated surface.

This enables the flow rate to be varied depending on the orientation of the heated surface.

In one embodiment, the control unit is configured to adjust the flow rate of the pump by selective suppression of a predetermined number of electrical signals prompting a pump stroke within a predetermined time period.

In one embodiment, a nozzle having an opening, wherein means are provided to vary the total area of the opening of the nozzle in dependence on the orientation of the heated surface determined by the orientation detector.

This enables the velocity of the fluid exiting the fluid inlet in a direction towards the heated surface to be changed.

The means to vary the total area of the opening area may comprise a gravity actuated valve.

In one embodiment, the steaming device further comprises an actuator configured to change location and/or orientation of the nozzle so to direct fluid to impact a preferred area of the heated surface.

This enables fluid to impact the heated surface within a predetermined region, thereby reducing unevaporated water accumulating in the steaming device.

In one embodiment the steaming device may be a steam iron or a steamer.

According to another aspect of the invention, there is provided a method of operating a steaming device comprising a steam generator having a heated surface, a pump, an orientation detector to detect orientation of the heated surface, and a control unit, the method including the step of the control unit operating the pump at a first flow rate, the orientation detector detecting a change in orientation of the heated surface and signalling orientation information to the control unit, and the control unit adjusting the flow rate to a second flow rate.

This method enables the steaming device to generate sufficient steam irrespective of its orientation without water spill-out, irregular or too little steam generation.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
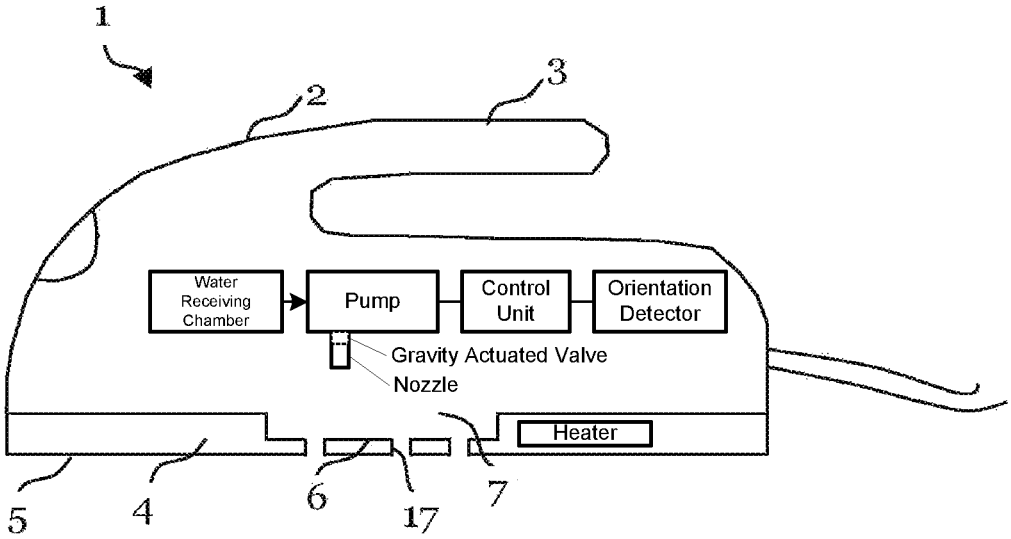
FIG. 1 shows a schematic illustration of a steam iron according to an embodiment of the present invention.

An embodiment of the present invention relates to a steam iron 1 acting as a steaming device as shown in FIG. 1. Such a steam iron 1 is generally used to apply steam to a fabric of a garment to remove creases from the fabric. Although the embodiments described below will relate to applying steam to the fabric of a garment, it will be appreciated that such a steam iron may be used to remove creases from other fabrics and materials. Furthermore, although in the embodiments described below the steaming device is a steam iron, it will be understood that the invention is not limited thereto and that the invention may relate to other types of steaming devices, such as a hand-held steamer or the like. Such alternative steaming devices can be used for applying steam for treating curtains and soft surfaces of upholstery such as textile coverings of furniture and mattresses.

Referring now to FIG. 1, the steam iron 1 comprises a housing 2 and a handle 3. The handle 3 is integrally formed with or attached to the housing 2, and is gripped by a user during use of the iron 1 to enable a user to manoeuvre and position the steam iron.

The steam iron further comprises a sole plate 4 with a steaming surface 5 which is pressed or located against the fabric of a garment during use. The sole plate 4 is formed from a heat conductive material such as cast aluminium. The steam iron 1 also comprises a heater (not shown) that is configured to heat up the sole plate 4. Typically, the heater is a heating coil of high electrical resistivity located in the sole plate 4. A control unit (not shown) is configured to operate the heater so that the sole plate heats up when prompted by a user input.

The steam iron also comprises a steam generator 8 having a heated surface 6 located in the housing 2. In this embodiment, the heated surface 6 is a surface of the sole plate 4 opposing that of the planar steaming surface 5. The heated surface 6 is depressed into the sole plate 4 such that it forms a steam generating chamber 7 which is partially shown in FIGS. 2 and 3. The heated surface 6 is configured to be heated to a sufficient temperature so as to ensure instantaneous flash boiling when in contact with water. The heated surface 6 should also have sufficient power density to ensure that intended amount of steam is generated when in contact with water. It should be appreciated that in alternative embodiments the heated surface of the steam generator 8 may be a separate component to the sole plate 4, and in such embodiments the heated surface 6 may be heated up independently of the sole plate 4.

The steam generating chamber 7 has a single fluid inlet 16 and a steam outlet 17 as seen in FIG. 1. The fluid inlet 16 provides a passageway to supply water to the steam generating chamber 7. The steam outlet 17 provides a passageway to feed steam from the steam generating chamber 7. The steam outlet 17 is formed by one or more passages extending through the sole plate 4 such that the steam is transferred onto the fabric of garment being ironed as best seen in FIG. 1.

A water receiving chamber (not shown) is disposed in the housing 2. Alternatively, in an un-illustrated embodiment, the water receiving chamber is disposed in a separate housing (not shown) connected to the steaming device via a tube (not shown). Water is stored in the water receiving chamber.

Figure 2:
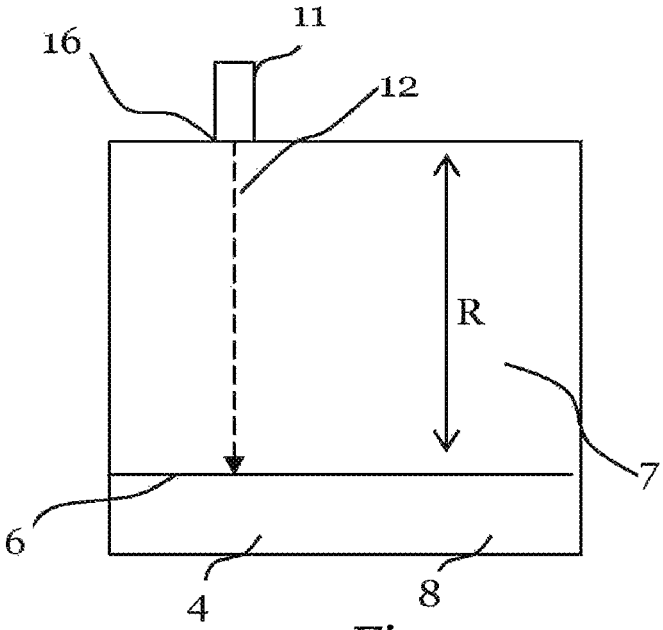
FIG. 2 shows a diagrammatic cross-sectional view of a steam generating chamber of the steam iron shown in FIG. 1 when said steam iron is in its ironing position.
Figure 3:
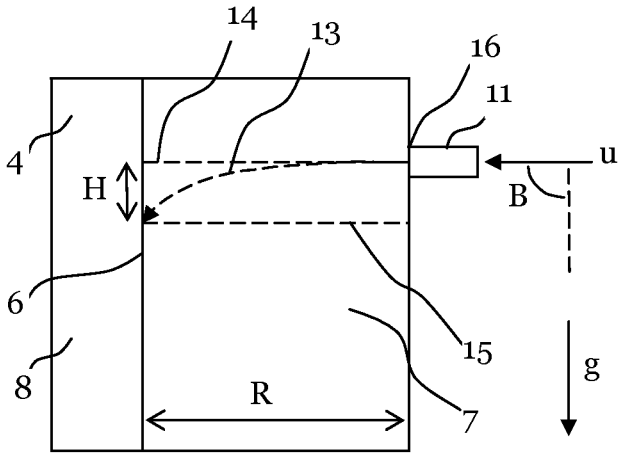
FIG. 3 shows a diagrammatic cross-sectional view of a steam generating chamber of the steam iron shown in FIG. 1 when said steam iron is in its upright or vertical position.

A pump (not shown) is connected to the water receiving chamber and is configured to pump water from the water receiving chamber onto or against the heated surface 6 of the steam generator 8 via a connector (not shown). The connector comprises a nozzle 11 formed with an opening, the nozzle locates in the fluid inlet 16 of the steam generating chamber 7 as seen in FIGS. 2 and 3. The opening of the nozzle 11 may be aligned with the fluid inlet 16 as shown in FIGS. 2 and 3. In an alternative embodiment, the nozzle 11 may extend into the steam generating chamber 7 such that the opening is located in the steam generating chamber 7 at a distance from the fluid inlet 16. The pump is a pulsating pump, activated by a series of repetitive and periodic electrical signals. Each of these electrical signals is responsible for a corresponding discharge of water from the pump (an event defined as a pump stroke) and the mechanical properties of the said discharge. The control unit controls the pump with regard to the periodic electrical signals determining the pump strokes. The control unit is configured to selectively suppress a predetermined number of electrical signals within a predetermined time period to adjust the flow rate of water ejected against the heated surface 6 as explained in more detail below. The pump may be an alternating current pump.

The steam iron 1 further comprises an orientation detector (not shown). The orientation detector detects the orientation of the plane of the heated surface 6 and outputs or signals the orientation information to the control unit. Preferably, the heated surface 6 of the steam generator 8 is parallel to the sole plate 4 such that the orientation detector indirectly detects whether the steam iron is in a normal operating position (ironing position) in which the steaming surface 5 extends in a horizontal plane, or inclined at an angle to the normal operating position, for example, in a vertical orientation relative to the horizontal plane (resting or upstanding position).

The orientation detector may be a ball sensor, a strain gauge or an accelerometer or any other means for detecting orientation. The orientation information may, for example, comprise an exact numerical value or it may be an abstract value representing a level or range of orientation measurements.

FIG. 2 shows a portion of the steam generating chamber 7 and water being pumped onto the heated surface 6 when the heated surface 6 is in a normal operating position or lies in a horizontal plane, i.e. the steam iron is in an ironing position wherein the sole plate 4 is pressed against a fabric of a garment. The arrow denoted 12 represents the trajectory path of water as it is pumped onto the heated surface 6 when the heated surface 6 is in said horizontal position. In this position, water is pumped from the water receiving chamber onto the heated surface 6 in the direction of gravity, thus gravity interferes minimally or not at all with the direction in which water is pumped.

FIG. 3 shows a portion of the steam generating chamber 7 and water being pumped onto the heated surface 6 when the heated surface 6 is in a vertical position or lies in a vertical plane, i.e. the steam iron is in an upright position. The arrow denoted 13 represents the trajectory path of water as it is pumped onto the heated surface 6 when the heated surface 6 is in said vertical position. As gravity (represented by arrow denoted "g") interferes with the direction in which the water is pumped when the heated surface 6 is in a vertical position, the pumped water follows a parabolic trajectory path as it impacts the heated surface 6.

According to the present invention, the control unit is configured to adjust or change the flow rate of the pump as it receives orientation information from the orientation detector. In one embodiment, the control unit is configured to decrease the flow rate of the pump when the heated surface 6 is moved by a user from being parallel to a horizontal plane to being parallel to a vertical plane. This is to allow sufficient time for water to spread across the heated surface 6 to evaporate and for the heated surface 6 to heat up again ready for next dose of water. Thus, the level of unevaporated water accumulating in the steam generating chamber 7 or other parts is reduced in comparison to those devices known from the prior art described in the introduction.

According to the present invention, the control unit adjusts the flow rate of the pump by selective suppression of a predetermined number of electrical signals within a predetermined time period. By reducing the number of the pump strokes over said time period without affecting individual strokes, the flow rate of the pump is reduced. Thus, the control unit is configured to selectively suppress pump strokes in a predetermined manner when the flow rate needs to be reduced.

The water trajectory path differs depending on the orientation of the heated surface 6 and also the exit velocity of water from the nozzle 11, and as such, water impacts the heated surface 6 at different locations if either of these parameters changes. The region of these locations or the tolerance of water impact is represented by arrow "H" in FIG. 3, and the point of impact when the heated surface 6 is in a horizontal position is represented by dotted line denoted 14 and the point of impact when the heated surface 6 is in a vertical position is represented by dotted line 15. The distance from the nozzle 11 and the heated surface 6 is represented by arrow "R" in FIGS. 2 and 3. The angle of the heated surface 6 relative to a horizontal plane is indicated as "B" and the exit velocity of the pumped water at the nozzle per pump stroke is represented by "u" in FIG. 3.

The relationship between H, R, B, g, and u, wherein H=the tolerance or region where water impacts the heated surface 6 as the heated surface is at different orientations in mm, R=distance from the opening of the nozzle 11 to the heated surface 6 in mm, B=θ=angle of the heated surface 6 relative to a horizontal plane in degrees, g=acceleration due to gravity in mm/s$^2$, and u=exit velocity of the pumped water at the nozzle per pump stroke in mm/s can be expressed as follows:

$$H = \frac{\tan\theta}{g\cos\theta} \times (u^2 + gR\cos\theta - u\sqrt{u^2 + 2gR\cos\theta}) \quad \text{if } 0° < \theta < 90°$$

$$H = \frac{gR^2}{2u^2} \quad \text{if } \theta = 90°$$

The above relationships show that by changing or adjusting the exit velocity (u) as the angle (θ) or orientation of the heated surface 6 is changed by a user using the steam iron, the tolerance or the region (H) where water impacts the heated surface 6 can be controlled. Thus, regardless of the orientation of the steam iron, or more specifically the heated surface 6, water will always impact the heated surface 6 within a specific region. The specific region may be a predetermined region such that when water hits or impacts the specific region of the heated surface 6, it spreads across the heated surface 6 enabling maximum heat contact and instantaneously flash boils.

The heated surface 6 of the steam generator 8 and the location of the point of impact of water 14 on the heated surface 6 in its normal ironing position are designed to maximise the heat transfer from the heated surface 6 to water so as to generate steam. It is therefore desirable that in an inclined or vertical position, water impacts as close as possible to the point of impact as when the steam generator 8 is in its horizontal position. Hence, it is desirable that the tolerance or the region (H) of the point of impact of water is minimised. As shown in the above relationships, for any given value of R, this can be achieved by maximising the exit velocity of the pumped water at the nozzle per pump stroke u.

The exit velocity of the pumped water at the nozzle per pump stroke u may be derived using the flow rate $Q_s$ (in $mm^3/s$) of the pump per stroke and the area A of the opening of the nozzle 11 (in $mm^2$) by the following relationship:

$$u = \frac{Q_s}{A}$$

Therefore, by decreasing the area A of the opening of the nozzle 11, the exit velocity can be increased.

Furthermore, the flow rate $Q_s$ of the pump (in presence of the delivery system) per stroke may be derived from the working flow rate of the pump in the delivery system Q ($mm^3/s$), the number of pulses per second n, and the time period of each useful stroke of the pump T (in seconds) using the following relationship:

$$Q_s = \frac{Q}{nT}$$

A high exit velocity of water or fluid u minimises the tolerance H as the steaming device is moved from an ironing position to an inclined or vertical position. In particular, a high exit velocity of water u enables the amount of contact of dosed water with the heated surface 6 to be maximised even when the direction of water is affected by gravity such that unevaporated water does not collect in parts of the steaming device causing excessive cooling of said parts and leaving areas of the heated surface 6 and/or other parts to overheat. Thus, the steam iron or any other steaming device comprising the above invention does not cause water to spill out onto garments, generate too little steam and/or generate irregular steam which adversely affects ironing results.

In one embodiment, the velocity of water being pumped against the heated surface 6 may remain substantially unchanged for any pump stroke, irrespective of the frequency of the pump strokes or the flow rate. Preferably, the velocity of the water or fluid exiting the fluid inlet 16 is of high or specific value so that the fluid impacts against the heated surface 6 within a predetermined region. Furthermore, the stroke volume of the pump is unchanged throughout operation of the steaming device.

An example of such a steaming device may consist of an iron with a normal ironing steam rate of 120 gm/min. This corresponds to an AC pump with a maximum flow rate of 120 $cm^3$/min in presence of the entire water delivery system. The value of Q for such a pump is 2000 $mm^3/s$. If the pump is assumed to work at the AC voltage at 50 Hz, n=50 and T=0.01 s. Hence, the exit flow rate of water at the nozzle per stroke $Q_s$ is 4000 $mm^3/s$. If a nozzle of diameter 1.2 mm and a consequent area of cross-section A equal to 1.13 $mm^2$ is used to dose water, the exit velocity of water at the nozzle per stroke u is 3536.78 mm/s. The value of the distance R of nozzle from heated surface 6 in one example may be 20 mm. If the iron is tilted to be used in the vertical position at an angle θ equal to 90°, the value of H (deviation of water impact from horizontal case) comes out to be 0.16 mm. In this vertical position, the control unit may drop the flow rate of the system to 30 $cm^3$/min, based on the configuration of the sole plate. Advantageously, as mentioned, the drop in flow rate does not have any effect on the value of H. Hence, the water will continue to shoot from the nozzle onto a predetermined region of the heated surface 6 to allow for better steam generation.

It should be understood that in addition to the flow rate, other parameters can be changed in order to reduce the amount of unevaporated water accumulating in the steaming device. For example, in one embodiment of the invention the steaming device may further comprise means to regulate the total area A of the opening of the nozzle 11 with respect to the orientation of the steam iron. By regulating the total area A, the velocity can be changed such that the tolerance or the region H where water impacts the heated surface 6 can be controlled as the orientation of the heated surface 6 is changed. The total area A may be regulated by activating mechanical (gravitational) or electro-mechanical means (using the feedback from the orientation detector). One example of a gravity actuated valve is a ball-valve kind of mechanism at the tip of the nozzle 11, where the orientation of the heated surface 6 determines the extent of blockage of the nozzle opening area A by the ball. Similarly, an electronic valve or electro-mechanical valve designed to constrict the nozzle area A at its tip by a predetermined amount when activated by the orientation detector can be used. Such a reduction in area A of the nozzle opening may further help focus the impact of the water spout within the required tolerance H of the heated surface 6.

In yet another alternative embodiment, the nozzle location and/or orientation may be changed by employing an actuator, for example, a servo motor, so as to cause the water to impact the heated surface 6 at a favourable area or within a predetermined region so as to maximize the contact area between the heated surface 6 and the water.

Advantageously, a steaming device according to the present invention produces a better ironing result as it is operable in a normal operating position (horizontal position) and in positions other than the normal operating positions without the drawbacks of water spill-out, irregular or too little steam generation. Furthermore, the steaming device produces a better ironing result as it is operable between a range of positions, i.e. from when the heated surface 6 is in a normal operating position, in which the heated surface 6 lies in a horizontal plane, to when the heated surface 6 is inclined at an angle to the normal operating position.

It should be understood that the above invention is not limited to a specific range of angles of the heated surface 6. For example, the steaming device can be used wherein the heated surface 6 is at any angle.

It should be understood that although the above described embodiments refer to water, the invention is not limited to water but any suitable fluid may be used with the present invention.

As described above, the present invention is not limited to a steam iron. The present invention relates to a steaming device for treating curtains and soft surfaces of upholstery such as textile coverings of furniture and mattresses, as well as fabric of garment and other material. Thus, it should be understood that the steaming device of the present invention does not have to comprise an ironing function.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A steaming device comprising:

a steam generator having a heated surface;

a pump configured to direct fluid against the heated surface to generate steam;

an orientation detector to detect an angle of orientation of the heated surface; and a control unit, wherein the control unit is configured to operate the pump to adjust a flow rate of the pump in dependence on the angle of orientation of the heated surface determined by the orientation detector.

2. The steaming device according to claim 1, wherein the control unit is configured to operate the pump at a first flow rate, and upon the orientation detector detecting a change in the angle of orientation of the heated surface, the control unit is configured to operate the pump at a second flow rate.

3. The steaming device according to claim 1, wherein the control unit is configured to operate the pump at a lower flow rate when the heated surface is in a second orientation than when the heated surface is in a first orientation.

4. A steaming device comprising:

a steam generator having a heated surface;

a pump configured to direct fluid against the heated surface to generate steam;

an orientation detector to detect orientation of the heated surface; and a control unit, wherein the control unit is configured to operate the pump to adjust the flow rate of the pump in dependence on the orientation of the heated surface determined by the orientation detector, wherein the control unit is configured to operate the pump at a lower flow rate when the heated surface is in a second orientation than when the heated surface is in a first orientation, wherein the first orientation is when the heated surface lies in a horizontal plane, and the second orientation is when the heated surface lies in a plane that is at an inclined angle relative to the horizontal plane.

5. The steaming device according to claim 4, wherein the second orientation is when the heated surface lies in a plane that is at an angle ranging from 5° to 90° relative to the horizontal plane.

6. The steaming device according to claim 1, further comprising:

a fluid inlet through which fluid enters the steam generator, wherein the pump directs fluid, via the fluid inlet, in a direction to impact the heated surface within a predetermined region of the heated surface, and wherein a velocity of the fluid exiting the fluid inlet is controlled, via the pump and control unit, to a specific value such that as the orientation of the heated surface changes, the fluid exiting the fluid inlet continues to impact the heated surface within said predetermined region.

7. The steaming device according to claim 1, further comprising a fluid inlet through which fluid enters and then exits in a direction so as to impact the heated surface, and a velocity of the fluid exiting the fluid inlet is unchanged irrespective of the angle of orientation of the heated surface.

8. A steaming device comprising:

a steam generator having a heated surface;

a pump configured to direct fluid against the heated surface to generate steam;

an orientation detector to detect orientation of the heated surface; and a control unit, wherein the control unit is configured to operate the pump to adjust a flow rate of the pump in dependence on the orientation of the heated surface determined by the orientation detector, wherein the control unit is configured to operate the pump to control the flow rate of fluid as a function of an angle of orientation of the heated surface.

9. The steaming device according to claim 1, wherein the control unit is configured to adjust the flow rate of the pump by selective suppression of a predetermined number of electrical signals prompting a pump stroke within a predetermined time period.

10. The steaming device according to claim 1, further comprising:

a nozzle having an opening; and means for varying a total area of the opening of the nozzle in dependence on the angle of orientation of the heated surface determined by the orientation detector.

11. The steaming device according to claim 10, wherein the means for varying the total area of the opening comprises a gravity actuated valve.

12. The steaming device according to claim 1, further comprising:

a nozzle having an opening; and an actuator configured to change a location and /or orientation of the nozzle, wherein the pump directs the fluid, via the nozzle and actuator, to impact a preferred area of the heated surface.

13. The steaming device according to claim 1, wherein the steaming device is a steam iron.

14. The steaming device according to claim 1, wherein the steaming device is a steamer.

15. A method of operating a steaming device that comprises a steam generator having a heated surface, a pump configured to direct fluid against the heated surface to generate steam, an orientation detector to detect an angle of orientation of the heated surface, and a control unit, the method comprising the steps of:

operating, via the control unit, the pump at a first flow rate;

detecting, via the orientation detector, a change in the angle of orientation of the heated surface and signalling orientation information to the control unit; and adjusting, via the control unit, a flow rate of the pump to a second flow rate, wherein the control unit is configured to operate the pump to control the flow rate of fluid as a function of the angle of orientation of the heated surface detected via the orientation detector.

* * * * *